US010000944B2

(12) United States Patent
Cavallaro, Jr.

(10) Patent No.: US 10,000,944 B2
(45) Date of Patent: Jun. 19, 2018

(54) GATE LATCH

(71) Applicant: The Bilco Company, New Haven, CT (US)

(72) Inventor: Anthony L. Cavallaro, Jr., Wallingford, CT (US)

(73) Assignee: The Bilco Company, New Haven, CT (US)

( * ) Notice: Subject to any disclaimer, the term of this patent is extended or adjusted under 35 U.S.C. 154(b) by 278 days.

(21) Appl. No.: 15/016,904

(22) Filed: Feb. 5, 2016

(65) Prior Publication Data

US 2017/0226777 A1 Aug. 10, 2017

(51) Int. Cl.

| | |
|---|---|
| ***E05B 15/02*** | (2006.01) |
| ***E05B 65/00*** | (2006.01) |
| ***E05C 3/12*** | (2006.01) |
| *E05B 15/00* | (2006.01) |

(52) U.S. Cl.

CPC ..... *E05B 65/0007* (2013.01); *E05B 15/0205* (2013.01); *E05C 3/12* (2013.01); *Y10S 292/29* (2013.01); *Y10T 292/68* (2015.04); *Y10T 292/683* (2015.04)

(58) Field of Classification Search

CPC .. Y10S 292/29; Y10T 292/68; Y10T 292/683; E05B 15/0205; E05B 65/0007

USPC ..... 292/230, 340–341.19

See application file for complete search history.

(56) References Cited

U.S. PATENT DOCUMENTS 134,877 A * 1/1873 Finley ..... E05F 11/00 292/238
193,678 A * 7/1877 Unger ..... E05F 11/00 292/238
194,255 A * 8/1877 Marshman ..... E05B 65/0007 292/120
205,590 A * 7/1878 Waller ..... E05C 19/02 292/207
207,823 A * 9/1878 Shellhouse ..... E05F 11/00 292/238

(Continued)

FOREIGN PATENT DOCUMENTS

AU 2014203447 A1 1/2016
CA 1046552 A1 * 1/1979

(Continued)

OTHER PUBLICATIONS

Intellectual Property Office of the United Kingdom, Search Report for GB1701927.4, dated Jun. 22, 2017.

*Primary Examiner* — Carlos Lugo

(74) *Attorney, Agent, or Firm* — Wiggin and Dana LLP; Gregory S. Rosenblatt

(57) ABSTRACT

A gate latch assembly includes strike mounting plate and a gate latch. The strike mounting plate has a base portion and a pin attachment portion. The gate latch has a second base portion and a pin engagement portion extending from a mid-portion of the second base portion. This pin engagement portion has a first prong and a second prong separated by a slot. A latch is pivotally mounted to the first prong and effective to releasably restrain a pin within the slot. The pin is affixed to the strike mounting plate and has a length effective to engage the slot. One feature of the assembly is that it is equally suitable for gates that swing to the left and for gates that swing to the right. Further, by changing the configuration of the pin, the gate latch assembly is suitable for sliding gates.

11 Claims, 8 Drawing Sheets

(56) References Cited

U.S. PATENT DOCUMENTS 277,807 A * 5/1883 Stovall ..... E05B 65/0811 292/128
394,685 A * 12/1888 Fether ..... E05B 65/0007 292/210
518,453 A * 4/1894 Hollar ..... E05B 15/10 16/DIG. 34
633,008 A * 9/1899 Jeffers ..... E05F 11/00 292/238
1,936,921 A * 11/1933 Strid ..... E05C 17/50 292/136
2,211,963 A * 8/1940 Strid ..... E05C 17/50 292/101
2,710,217 A * 6/1955 Curtiss, Jr. ..... E05B 15/0245 292/341.18
3,325,204 A 6/1967 Case
3,740,022 A 6/1973 DiGiovanni
3,776,521 A 12/1973 Weinert
4,305,611 A * 12/1981 Robins ..... E05B 63/0056 292/1
4,536,022 A 8/1985 Giordano
4,643,469 A 2/1987 Johnston et al.
5,103,658 A 4/1992 McQuade
5,145,153 A 9/1992 Glynn
5,188,342 A 2/1993 Ouellette et al.
5,215,342 A * 6/1993 Yuge ..... E05B 85/045 292/340
5,237,724 A * 8/1993 Lee ..... E05C 17/025 16/375
5,593,141 A 1/1997 Cain et al.
6,000,737 A * 12/1999 Yiu ..... E05B 85/045 292/340
6,053,281 A 4/2000 Murray
6,672,634 B2 * 1/2004 Burton ..... E05B 85/045 292/340
6,783,163 B2 * 8/2004 Sadler ..... E05L 35/00 292/340
6,931,793 B2 8/2005 Joyce et al.
7,021,678 B1 4/2006 Raoult
7,140,652 B2 * 11/2006 Johnson ..... E05B 85/045 292/340
7,201,030 B2 * 4/2007 Timothy ..... E05B 65/0007 292/127
7,416,228 B2 * 8/2008 Pfitzinger ..... E05B 15/0046 292/214
7,878,558 B1 2/2011 Bell
8,167,341 B2 * 5/2012 Gruber ..... B62D 33/037 292/201
8,308,205 B2 * 11/2012 Tejszerski ..... E05B 65/0007 292/230
8,733,807 B2 * 5/2014 Williams ..... E05L 315/024 292/340
D725,792 S 3/2015 Cullen et al.
9,109,377 B1 * 8/2015 Guttery ..... E05B 15/024
9,803,396 B2 * 10/2017 Timothy ..... E05C 3/06
2004/0104382 A1 6/2004 Collins et al.
2006/0101876 A1 5/2006 Timothy
2007/0175250 A1 8/2007 Karcz et al.
2009/0108591 A1 * 4/2009 De Vries ..... E05B 15/0245 292/64
2010/0045055 A1 * 2/2010 Taglianetti ..... E05L 31/0015 292/341.15
2013/0069375 A1 * 3/2013 Jeffries ..... E05C 17/52 292/307 R

FOREIGN PATENT DOCUMENTS

CA 2454213 A1 * 6/2005 ..... E05B 65/0007
EP 1617024 A2 1/2006
EP 1741856 A2 * 1/2007 ..... E05B 63/24
EP 2813650 A1 * 12/2014 ..... E05B 65/0007
WO WO-2011088496 A1 * 7/2011 ..... E05B 65/0007

* cited by examiner

GATE LATCH

CROSS-REFERENCE TO RELATED APPLICATIONS

N.A.

STATEMENT REGARDING FEDERALLY SPONSORED RESEARCH OR DEVELOPMENT

N.A.

BACKGROUND OF THE DISCLOSURE

Field of the Disclosure

Disclosed herein is a latch for a swinging gate or a sliding gate. More particularly, there is disclosed a gate latch for use with a safety fence surrounding a roof access hatch.

Description of Related Art

Safety regulations require that scuttles, or roof access hatches, provide some means of protecting workers on a roof from inadvertently falling through an open hatch. One method of protection is to surround the hatch with a safety railing or a safety fence to assist workers accessing the roof via the scuttle and to prevent workers on the roof from inadvertently falling through an open hatch. The distance from the roof to the top floor of a building may be on the order of 30 feet or more, so a secure safety system is required. One such safety system is disclosed in U.S. Pat. No. 6,931,793, titled "Roof Scuttle Safety Railing System, to Joyce et al. that is incorporated by reference herein in its entirety.

Safety regulations further require that a gate latch on the safety railing or safety fence surrounding a roof scuttle be able to withstand a force of at least 200 pounds without opening. Prudent engineering design practices commonly utilize a safety factor of two. Therefore, the latching mechanism should be capable of supporting a static load of 400 pounds. Commercial requirements further require that the gate latch be suitable for use with all three of: swinging gates that open to the right; swinging gates that open to the left; and sliding gates. Conventional gate latches, typically stamped from sheet metal are unlikely to be able to withstand 400 pounds of force. There remains a need for a gate latch, particularly suitable for use with roof scuttles, that meets both these safety regulations and commercial requirements.

BRIEF SUMMARY

Accordingly, there is provided a gate latch assembly. The gate latch assembly includes a combination of a strike mounting plate and a gate latch. The strike mounting plate has a generally first planar base portion and a pin attachment portion extending from a mid-portion of the first generally planar base portion. This pin attachment portion has a through hole extending therethrough with a longitudinal axis of the through hole being substantially parallel to the first generally planar base portion. The gate latch has a second generally planar base portion and a pin engagement portion extending from a mid-portion of the second generally planar base portion. This pin engagement portion has a first prong and a second prong separated by a slot. A latch is pivotally mounted to the first prong and effective to releasably restrain a pin within the slot. The pin is affixed to the strike mounting plate via the through hole and has a length effective to engage the slot.

One feature of the assembly is that it is equally suitable for gates that swing to the left and for gates that swing to the right. Further, by changing the configuration of the pin, the gate latch assembly is suitable for sliding gates.

The details of one or more embodiments of the invention are set forth in the accompanying drawings and the description below. Other features, objects and advantages of the invention will be apparent from the description and drawings, and from the claims

BRIEF DESCRIPTION OF THE DRAWINGS

Like reference numbers and designations in the various drawings indicate like elements.

DETAILED DESCRIPTION

Figure 1:
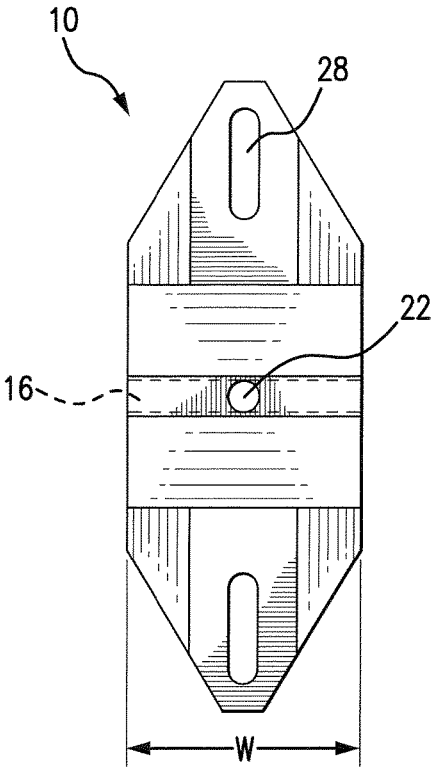
FIG. 1 is a top view of a strike mounting plate for use with the gate latch assembly disclosed herein.
Figure 3:
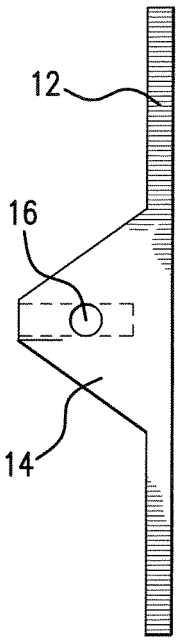
FIG. 3 is a side view of the strike mounting plate.
Figure 2:
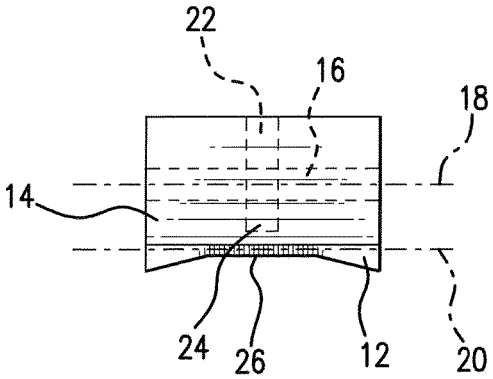
FIG. 2 is a front view of a first embodiment of the strike mounting plate.

With reference to FIGS. 1-3, a strike mounting plate 10 for use with the gate latch assembly disclosed herein has a base portion 12. A pin attachment portion 14 extends from a mid-portion of the base portion 12. A first hole 16 extends through the pin attachment portion 14. As best viewed in FIG. 2, the first hole 16 has a longitudinal axis 18 that is substantially parallel to the plane 20 of the base portion 12. The first hole 16 is sized to receive the arms of a U-shaped pin for use with a sliding gate as disclosed below. A second hole 22 extends into the pin attachment portion 14 in a direction generally perpendicular to the plane 20 of the base portion 12. This second hole 22 terminates at a blind bore 24 within the pin attachment portion 14. The second hole 22 is sized to receive a generally straight pin for use with a swinging gate as disclosed below. The first hole 16 and second hole 22 accommodate pins of different lengths and also enable a pin to be adjusted horizontally to accommodate varying distances between the gate and the post.

Figure 4:
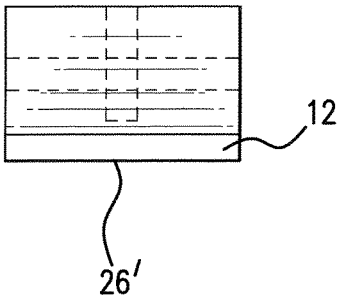
FIG. 4 is a front view of a second embodiment of the strike mounting plate.

An exterior surface 26, 26' forms an integral mounting bracket enabling mounting of the strike mounting plate 10 on curved or flat surfaces. As shown in FIG. 2, the exterior surface 26 of the base portion 12 may be curved to facilitate attachment to a round gate or port. Alternatively, as shown in FIG. 4, the exterior surface 26' may be flat to facilitate mounting to square tubing, a wood post, or other mounting adapters that may be provided by others. Mounting slots 28 are used to bolt, screw or otherwise affix the strike mounting plate to a gate post. The extended length of the mounting slot 28 provides adjustability in a vertical direction to compensate for a gate that has sagged.

The strike mounting plate 10 may be manufactured from a variety of materials that resist damage when exposed to the outdoors. Suitable materials include polymers, woods and metals. These materials may be coated, such as by painting, or chemically treated, such as by galvanizing, to enhance corrosion resistance. Fabrication can be by methods such as 3-D printing, casting, injection molding and machining.

Figure 5:
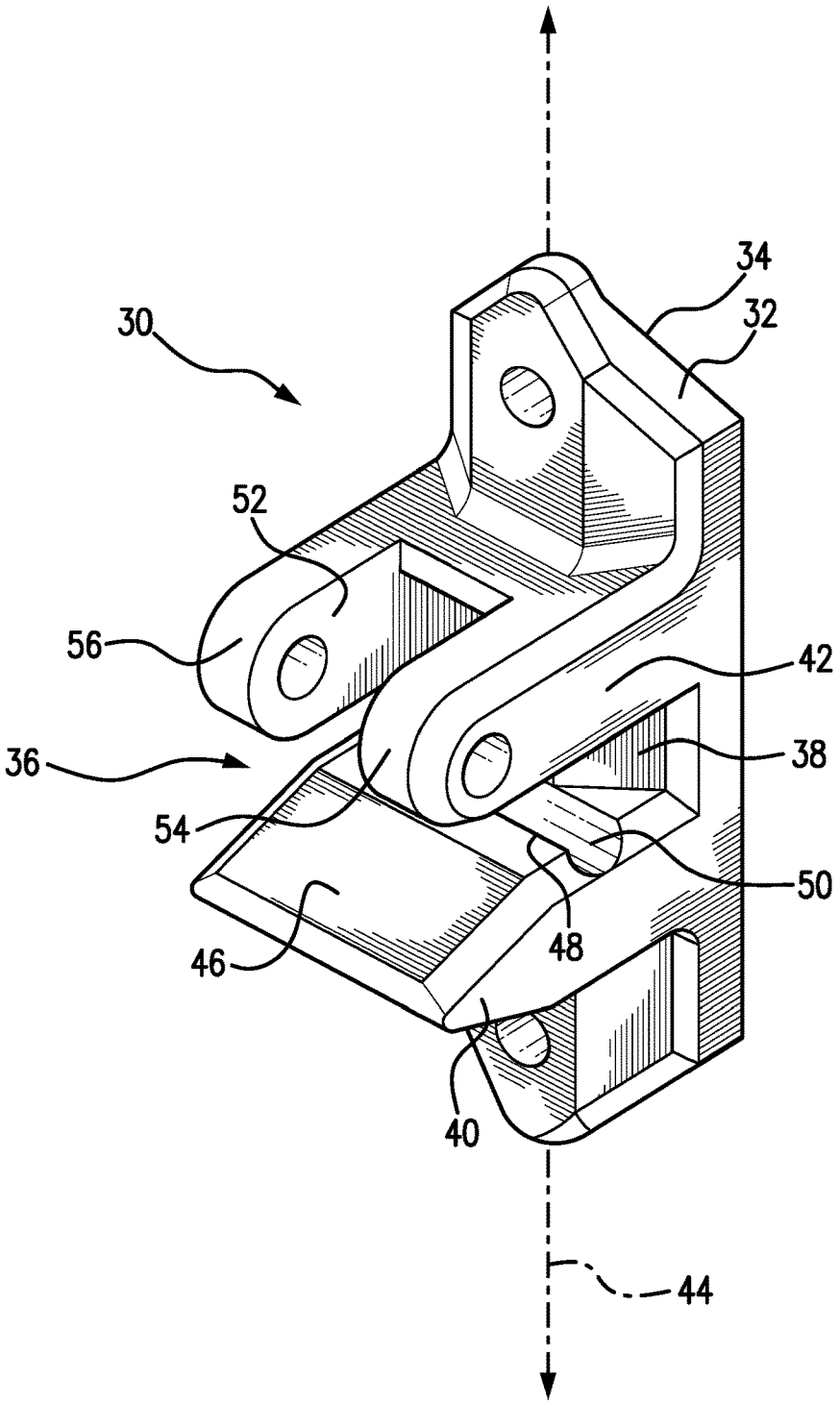
FIG. 5 is a side perspective view of a gate latch for use with the gate latch assembly disclosed herein.

FIG. 5 is a side perspective view of a gate latch 30. The gate latch 30 has a generally planar base portion 32. As described above, an exterior surface 34 of the base portion may be curved to facilitate attachment to a round gate or port. Alternatively, the exterior surface 34 may be flat to facilitate mounting to square tubing, a wood post, or other mounting adapters that may be provided by others. The gate latch 30 includes a pin engagement portion 36 extending from a mid-portion of the base portion 32. The pin engagement portion 36 includes a slot 38 bordered by a first prong 40 and a second prong 42.

The gate latch 30 is typically mounted vertically, along the axis 44, with the second prong 42 being above the first prong 40 enabling gravity to assist with the latching and to retain the pin in the latched position. A top surface of the first prong 40 includes the following three segments aligned from most distant from the base portion 32 to closest to the base portion: a first ramp portion 46 that slopes upwardly in the direction of the base portion 32, a second ramp portion 48 that slopes downwardly in the direction of the base portion 32 and retention notch 50. The first ramp portion 46 and second ramp portion 48 guide the pin to the preferred latched position. The pin receiving groove is shaped to receive a portion of the cross-sectional area of the pin. If that portion of the pin that is received is too small, the pin will slide out of the retention notch 50 too easily. If that portion is too large, it will be difficult to slide the pin out of the retention notch 50. Typically this portion will be from 20%-60% of the cross sectional area of the pin and more preferably, from 30%-40% if the cross sectional area. Retention notch 50 is also effective to reduce or eliminate vibration and rattling of the gate.

The second prong 42 includes a latch receiving slot 52 separated by a first aim 54 and a second aim 56 that project outward from the base portion 32. As described below, a latch is received within the latch receiving slot and pivots within the slot to lock the pin in the retention notch 50 or allow for the pin to exit from the retention notch 50. Hole 58 in the first arm 54 and hole 60 in the second arm receive an axle that extends through the latch. The latch then pivots about this axle.

The gate latch 30 may be manufactured from a variety of materials that resist damage when exposed to the outdoors. Suitable materials include polymers, woods and metals. These materials may be coated, such as by painting, or chemically treated, such as by galvanizing, to enhance corrosion resistance. Fabrication can be by methods such as 3-D printing, casting, injection molding and machining.

Figure 6:
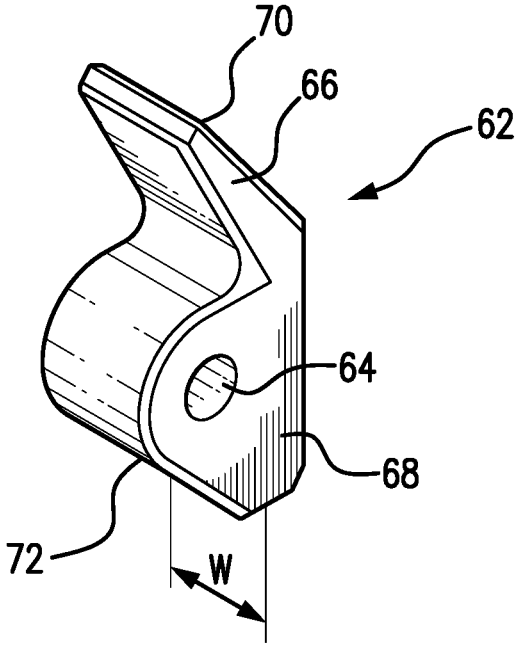
FIG. 6 is a side perspective view of a first latch for use with the gate latch assembly disclosed herein.

FIG. 6 is a side perspective view of a latch 62 for use with the gate latch assembly disclosed herein. The latch 62 has a width, w, sized to fit within the latch receiving slot (reference numeral 52 in FIG. 5) with sufficient spacing to allow free rotation within the latch receiving slot. Hole 64 extends through the latch 62 to receive the axle (not shown). The latch 62 includes a release tab 66. Pressing down on the release tab 66 causes an engagement portion 68 to pivot into the latch receiving slot enabling the gate to be opened. Release tab 69 may include a serrated surface 70 to assist a user pressing down on the release tab 66 to open the gate.

The engagement portion 68 includes the bulk of the mass of the latch 62 to maintain the center of gravity of the latch to the rear of the latch pivot point 64. This allows for gravity to drop the latch without the use of springs or any other assistive force being applied. Latch 62 includes a sloped surface 72 that engages the second ramp portion of the gate latch (reference numeral 48 in FIG. 5) to provide positive retention against outward pulling forces applied to the gate.

Figure 7:
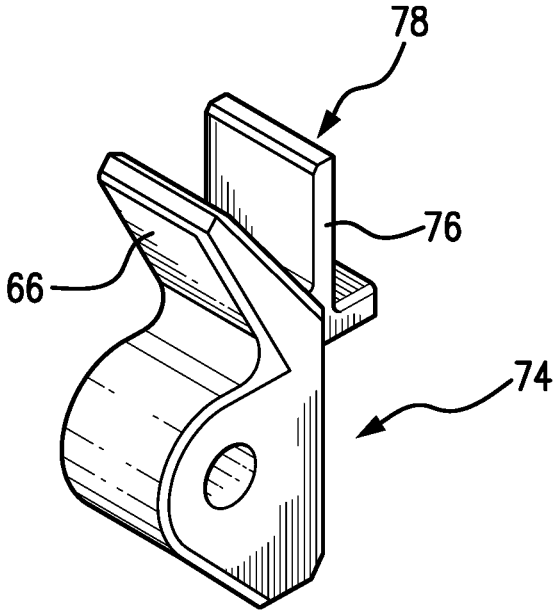
FIG. 7 is a side perspective view of a second latch for use with the gate latch assembly disclosed herein.

FIG. 7 is a side perspective view of an alternative latch 74 for use with the gate latch assembly disclosed herein. While similar in many respects to the latch 62 (FIG. 6), in addition to the release tab 66, there is a plunger tab 76. Pressing on a spring loaded plunger (not shown) applies a force against surface 78 causing the latch 74 to pivot and open.

Figure 8:
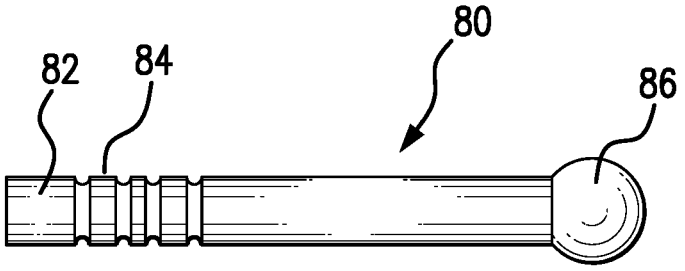
FIG. 8 is a side view of a pin for use with the gate latch assembly disclosed herein in combination with a swinging gate.

FIG. 8 is a side view of a pin 80 for use with, a swinging gate. Referring to FIG. 1 in combination with FIG. 8, an insertion end 82 of the pin 80 is inserted into the second hole 22. The diameter of the insertion end 82 is about equal, or slightly smaller, than the diameter of the second hole 22 so that a snug fit is achieved. Ferrules 84 may be included to enhance locking of the insertion end 82 into the second hole 22. Knob 86 may be provided at an opposing end of the pin 80 both to help retain the pin 80 in the retention notch 50 (FIG. 5) and to provide a smooth surface to prevent users who contact the pin from getting cut.

Figure 9:
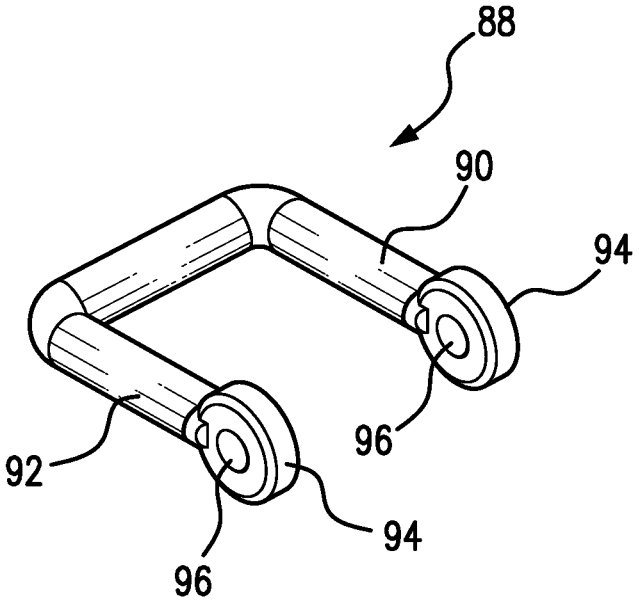
FIG. 9 is a side view of a pin for use with the gate latch assembly disclosed herein in combination with a sliding gate.

FIG. 9 is a side view of a pin 88 for use with a sliding gate. Referring to FIG. 1 in combination with FIG. 8, the pin 88 is generally u-shaped with opposing first arm 90 and second arm 92, both terminating at a toroid 94 having a through hole 96. Pin 88 spans the width, w, of the strike mounting plate 10 with the through holes 96 aligned with the first hole 16. A bolt, rivet, or other fixturing mechanism (not shown) then joins the pin 88 to the strike mounting plate with opposing engagement surface 98 effective to engage the retention notch 50 (FIG. 5).

Pin 80 and pin 88 are typically formed from a corrosion resistant metal such as stainless steel.

Figure 10:
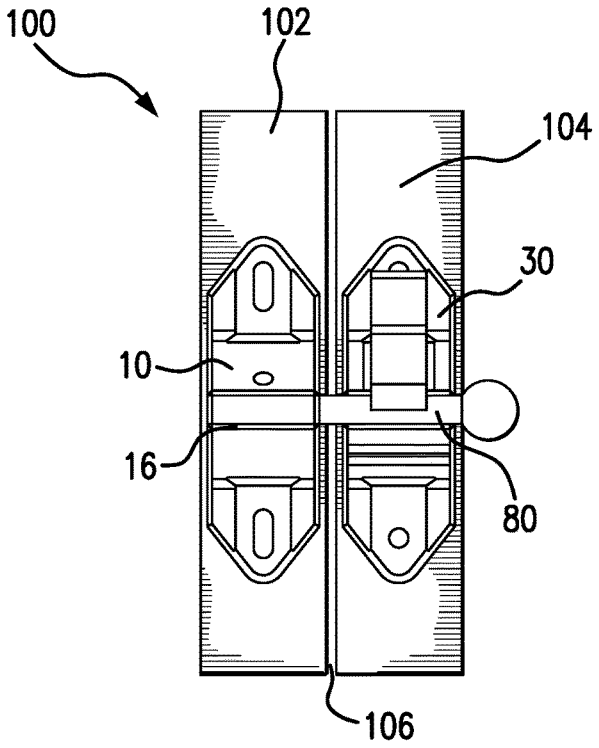
FIG. 10 illustrates the gate latch assembly for a swinging gate.

FIG. 10 illustrates a gate latch assembly 100 for use with a swinging gate. A strike mounting plate 10 is fastened to a swinging gate portion 102. A gate latch 30 is fastened to a stationary fence post or door jamb 104. Pin 80 extends from first hole 16 to be restrained by latch 62 spanning the gap 106 between the swinging gate 102 and the stationary fence post 104.

Figure 11:
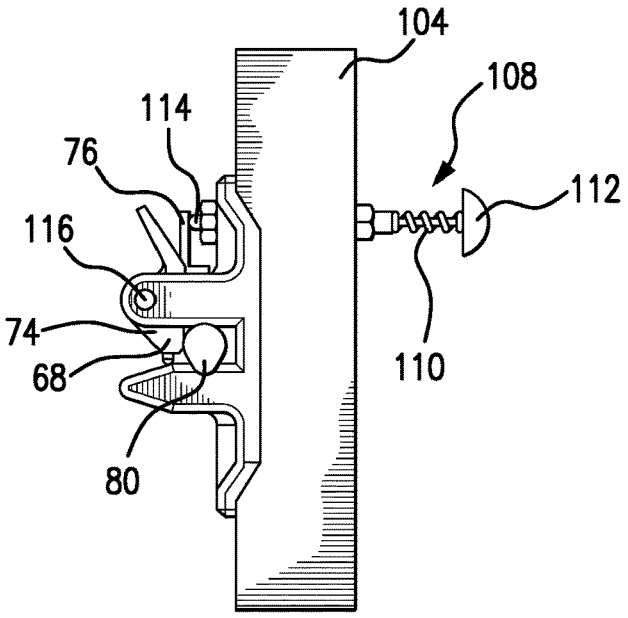
FIG. 11 illustrates a plunger mechanism for opening the gate latch assembly.

FIG. 11 illustrates a plunger 108 for opening the gate latch assembly. The plunger 108 is typically mounted on and through the stationary fence post or door jamb 104. A compression spring 110 is expanded when not-engaged. Depressing release button 112 compresses the compression spring 110 and causes the tip 114 of the plunger 108 to engage the plunger tip 76 of latch 74 causing the engagement portion 68 to pivot inward on axle 116 thereby releasing pin 80.

Figure 12:
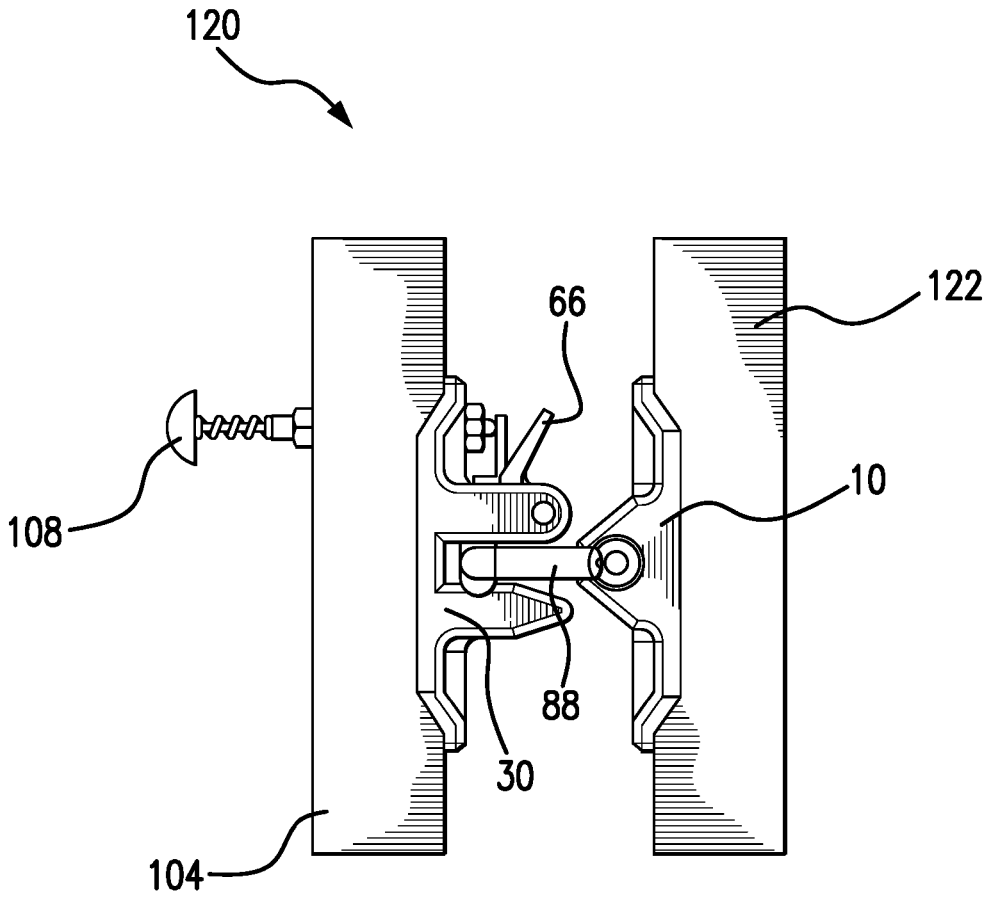
FIG. 12 illustrates the gate latch assembly for a sliding gate.

FIG. 12 illustrates the gate latch assembly 120 for a sliding gate with a strike mounting plate 10 fastened to an edge of a sliding gate 122. Pin 88 engages gate latch 30 that is fastened to an edge of a stationary fence post 104 or door jamb. The optional plunger 108 provides one mechanism to open the gate latch assembly 120 while release tab 66 provides another opening mechanism. The plunger is useful for applications where the gate latch assembly and the release tab are not readily accessible. For example, when the latch is to be opened from the side opposite the gate latch assembly or when the gate latch assembly is positioned high up on a gate post.

Figure 13:
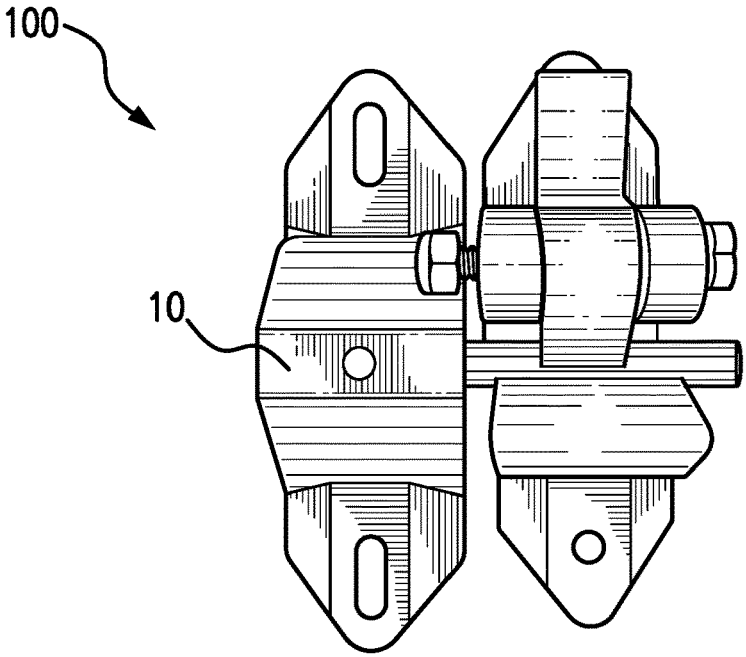
FIG. 13 is a photograph illustrating the gate latch assembly with a swinging gate where the swinging gate portion is on the left.
Figure 14:
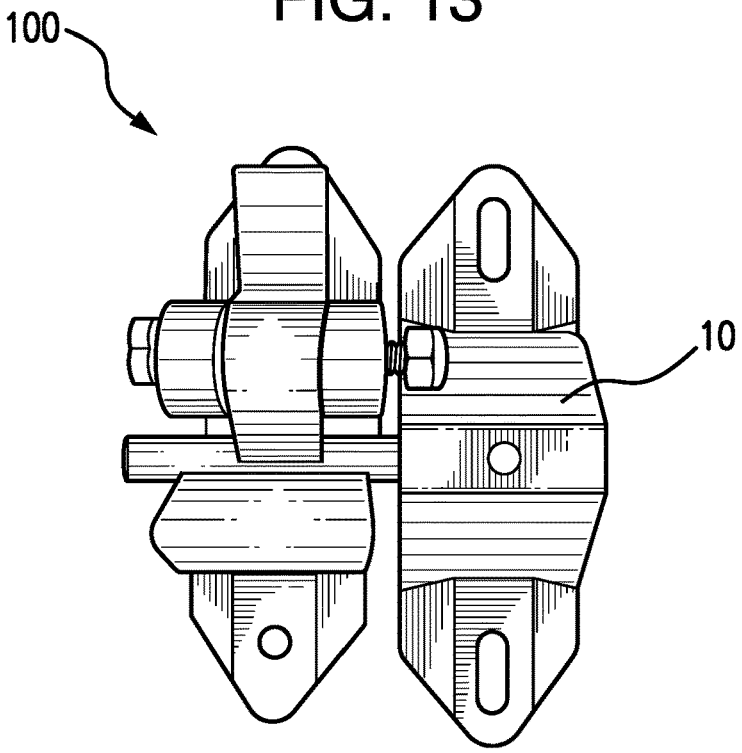
FIG. 14 is a photograph illustrating the gate latch assembly with a swinging gate where the swinging gate portion is on the right.

FIG. 13 is a photograph illustrating the gate latch assembly 100 for use with a swinging gate where the swinging gate portion and the strike mounting plate 10 are on the left. FIG. 14 is a photograph illustrating the gate latch assembly 100 for use with a swinging gate where the swinging gate portion and strike mounting plate 10 are on the right. FIGS. 13 and 14 illustrate how the same components may be used for both right opening gates and left opening gates.

Figure 15:
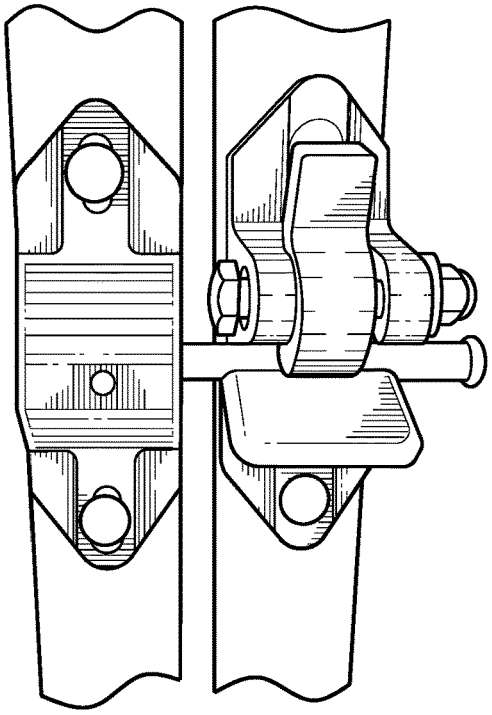
FIG. 15 is a photograph illustrating the gate latch assembly mounted to a safety railing.
Figure 16:
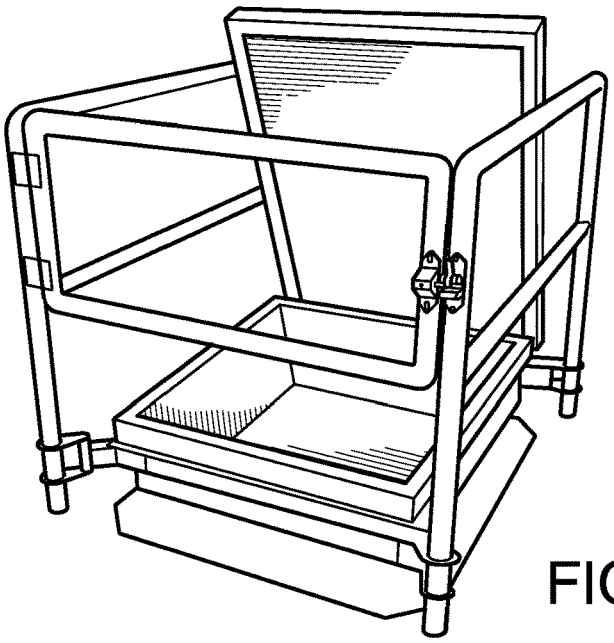
FIG. 16 is a photograph illustrating the gate latch assembly in combination with a roof scuttle.

FIG. 15 is a photograph illustrating the gate latch assembly mounted to a safety railing. FIG. 16 is a photograph illustrating the gate latch assembly in combination with a roof scuttle.

One or more embodiments of the present invention have been described. Nevertheless, it will be understood that various modifications may be made without departing from the spirit and scope of the invention. For example, the gate latch assembly may be used to limit access to a swimming pool to an industrial site. Accordingly, other embodiments are within the scope of the following claims.

I claim:

1. A gate latch assembly, comprising:

a strike mounting plate having a generally first planar base portion and a pin attachment portion extending from a mid-portion of said first generally planar base portion, said pin attachment portion having a first through hole extending therethrough wherein a longitudinal axis of said through hole is substantially parallel to the first generally planar base portion and a first blind bore extending generally perpendicularly to said first generally planar base portion;

a gate latch having a second generally planar base portion and a pin engagement portion extending from a mid-portion of said second generally planar base portion, said pin engagement portion having a first prong and a second prong separated by a slot, and a latch pivotally mounted to said first prong and effective to releasably restrain a pin within said slot; and wherein the strike mounting plate is positioned with respect to the gate latch in a first configuration, wherein said pin is affixed to the strike mounting plate via the blind bore and having a length extending generally perpendicular to the base plate effective to engage said slot, and wherein the strike mounting plate is positioned with respect to the gate latch in a second configuration, wherein said pin is affixed to the strike mounting plate via said first through hole and having a length generally parallel to the base plate effective to engage said slot.

2. The gate latch assembly of claim 1 wherein said first prong includes a pin retention notch.

3. The gate latch assembly of claim 2 wherein said pin retention notch is effective to receive from 20% to 60% of the cross-sectional area of the pin.

4. The gate latch assembly of claim 2 wherein the second prong has a first arm separated from a second arm with a latch receiving slot disposed therebetween.

5. The gate latch assembly of claim 4 wherein said first arm has a second through hole, said second arm has a third through hole and said latch has a fourth through hole and an axle extends through said second through hole, said third through hole and said fourth through hole and said latch is pivotable about said axis.

6. The gate latch assembly of claim 5 wherein said latch has an outwardly projecting release tab.

7. The gate latch assembly of claim 5 wherein said latch has an outwardly projecting plunger tab.

8. The gate latch assembly of claim 5 wherein said latch has both an outwardly projecting release tab and an outwardly projecting plunger tab.

9. The gate latch assembly of claim 7 wherein a plunger extends through a support for said gate latch and is positioned to engage said plunger tab when depressed.

10. The gate latch assembly of claim 8 wherein a plunger extends through a support for said gate latch and is positioned to engage said plunger tab when depressed.

11. The gate latch assembly of claim 1 in combination with a roof scuttle.

* * * * *